United States Patent [19]

Dudley et al.

[11] Patent Number: 4,999,469

[45] Date of Patent: Mar. 12, 1991

[54] APPARATUS FOR MICROWAVE HEATING TEST COUPONS

[75] Inventors: Kenneth W. Dudley, Sudbury; Richard H. Edgar, Chelmsford; E. Eugene Eves, II, Westford, all of Mass.

[73] Assignee: Raytheon Company, Lexington, Mass.

[21] Appl. No.: 503,025

[22] Filed: Apr. 2, 1990

[51] Int. Cl.[5] ..... H05B 6/80

[52] U.S. Cl. ..... 219/10.55 A; 219/10.55 D; 156/379.6; 156/273.7

[58] Field of Search ..... 219/10.55 A, 10.55 D, 219/10.55 R, 10.55 F, 10.53, 10.73; 156/379.6, 380.9, 272.2, 273.7

[56] References Cited

U.S. PATENT DOCUMENTS

| | | | |
|---|---|---|---|
| 3,426,439 | 2/1969 | Ryman et al. | 219/10.61 X |
| 3,461,261 | 8/1969 | Lewis et al. | 219/10.55 A |
| 3,560,694 | 2/1971 | White | 219/10.55 A |
| 3,584,177 | 6/1971 | Bucksbaum | 219/10.55 |
| 4,053,731 | 10/1977 | Foerstner | 219/10.55 |
| 4,269,581 | 5/1981 | Ury et al. | 219/10.55 A |
| 4,476,363 | 10/1984 | Berggren et al. | 219/10.55 A |
| 4,488,027 | 12/1984 | Dudley et al. | 219/10.55 D |
| 4,772,770 | 9/1988 | Matsui et al. | 219/10.55 A |
| 4,866,231 | 9/1989 | Schneider | 219/10.55 A |

OTHER PUBLICATIONS

H. Puschner "Heating with Microwaves" 1966, pp. 113 & 115.

*Primary Examiner*—Philip H. Leung

*Attorney, Agent, or Firm*—William R. Clark; Richard M. Sharkansky

[57] ABSTRACT

A test bonding apparatus comprising a rectangular wave-guide having a first pair of spaced opposing side walls attached to an orthogonal pair of spaced opposing side walls which are relatively wider. The waveguide includes an input portion, an intermediate bonding chamber portion and a terminating end portion which disposed in communication with one another. Coupled to the input portion is a microwave source and a coolant source for propagating consistently through the bonding chamber portion microwave energy having a predominant frequency associated with a predetermined wavelength, and a flow of coolant fluid. The relatively wider side walls in the bonding chamber portion of the waveguide have disposed along their longitudinal centerlines respective aligned slots. Each of the slots has opposing longitudinal edges disposed adjacent open ends of respective quarter wavelength chokes which are supported externally of the waveguide. Thus, a high impedance is established at each of the slots for preventing leakage of microwave energy therefrom. Within the bonding chamber portion, an aligned pair of dielectric clamping plates are supported by respective dielectric grid-like structures which permit passage of microwave energy and coolant fluid longitudinally through the bonding chamber portion. The terminating end portion is provided with a matched load for dissipating microwave energy and with a screened output aperture for permitting egress of heat carrying coolant fluid.

12 Claims, 2 Drawing Sheets

APPARATUS FOR MICROWAVE HEATING TEST COUPONS

BACKGROUND OF THE INVENTION

1. Field of the Invention

This invention relates generally to bonding apparatus and is concerned more particularly with a test bonding apparatus having means for consistently heating sample sandwiched layers of thermosetting adhesive material.

2. Discussion of the Prior Art

In the production of plastic assemblies, each of the assemblies may have component parts joined to one another by interposed layers of thermosetting adhesive, such as epoxy bonding material, for example. The bonding properties of the adhesive may be tested prior to making a production run by placing a sample layer of the adhesive between overlapping portions of two relatively small plastic sheets or panels which generally are referred to as "coupons". Thus, the overlapping portions of the coupons and the sample layer of adhesive therebetween comprise a test sandwich assembly for studying the interlocking joint formed by the cured adhesive. From the study of this interlocking joint, conclusions may be drawn regarding optimal operating conditions for making the production run of the larger plastic assemblies.

The test sandwich assembly may be clamped between two pressure plates which are urged toward one another by suitable fastener means, such as screws passing through both of the pressure plates, for example. The clamped sandwich assembly then may be placed in a heated environment, such as an oven, for example, whereby heat energy is transmitted to the sample layer of adhesive between the two coupons. As a result, there is formed between the overlapping portions of the two coupons a cured adhesive joint which may be subjected to reliability tests, such as shear tests, for example.

However, it may be found that the test results, thus obtained, are not repeatable due to inconsistent heating of the adhesive layer in the oven. Consequently, a second test sandwich assembly similar to the first sandwich assembly and heated in the same oven for an equal interval of time may produce an adhesive joint which is more or less reliable than the adhesive joint achieved with the first sandwich assembly. Also, it may be found that attempts to provide an enclosure with means for consistently heating the adhesive layer may result in access to the interior of the enclosure being rendered difficult. As a result, considerable time may be consumed in placing a test sandwich assembly within the enclosure and in removing the test sandwich assembly from the enclosure.

SUMMARY OF THE INVENTION

These and other disadvantages of the prior art are overcome by this invention providing a test bonding apparatus with a coupon bonding chamber comprising an integral portion of a waveguide type transmission line wherein microwave energy is propagated in a consistent manner. Also, the coupon bonding chamber includes an entrance slot and an aligned exit slot which are disposed in respective opposing side walls of the transmission line for permitting ready access to the interior of the chamber. The entrance and exit slots are provided with respective choke means for preventing leakage of microwave energy through the slots. Thus, the choked entrance and exit slots aid in maintaining propagation of microwave energy through the coupon bonding chamber in a consistent manner.

The coupon bonding chamber is disposed between an input end portion of the transmission line coupled to a microwave source, and a terminating end portion of the line which may include a matched load having means for dissipating microwave energy. The microwave source may comprise a magnetron tube connected electrically to a power supply and having an output antenna-like probe extended into the input end portion of the transmission line. Thus, the magnetron tube is disposed for radiating longitudinally into the transmission line microwave energy having a predominant frequency associated with a predetermined wavelength.

The transmission line may comprise a hollow waveguide having a rectangular cross-section formed by a relatively wide pair of spaced opposing side walls which are joined orthogonally to a relatively narrow pair of spaced opposing side walls. The respective widths of the waveguide side walls are related to the aforesaid predetermined wavelength such that the microwave energy radiated from the source is propagated in a preferred $TE_{10}$ mode along the waveguide. Consequently, the electric field vectors of the propagated microwave energy are approximately perpendicular to the relatively wide side walls of the waveguide and are substantially parallel with the relatively narrow side walls of the waveguide. Thus, the side walls of the waveguide are disposed for enhancing consistent propagation of the microwave energy along the waveguide.

The entrance and exit slots of the coupon bonding chamber are disposed approximately on the longitudinal centerlines of the respective relatively wide side walls of the waveguide. Consequently, the electric field vectors of the propagated microwave energy are substantially perpendicular to the entrance and exit slots in the plane thereof. Accordingly, a test sandwich assembly comprising a sample layer of thermosetting adhesive disposed between two coupons of dielectric material may be inserted through the entrance slot and into the interior of the coupon bonding chamber As a result, the sample layer of thermosetting adhesive will be approximately parallel with the relatively narrow side walls of the waveguide and with the electric field vectors of the propagated microwave energy. Thus, the sample layer of thermosetting adhesive in the test sandwich assembly is disposed for direct heating in a consistent manner by the microwave energy propagated through the coupon bonding chamber After a predetermined curing time interval, the test sandwich assembly is withdrawn from the coupon bonding chamber through the exit slot thereof.

There may be disposed in the coupon bonding chamber a pressure means made of dielectric material and comprising a pair of opposed clamping plates supported for relative movement by respective grid-like members. The plate supporting members are provided with respective grid-like structures to minimize disturbance of the microwave energy propagated through the coupon bonding chamber Thus, the clamping plates are moved into pressure engagement with respective opposing broad surfaces of the test sandwich assembly by grid-like support members designed to maintain the consistency of the microwave field within the coupon bonding chamber.

The input end portion of the waveguide transmission line may be disposed in communication with a source of coolant fluid, such as an electrically powered blower directing a flow of coolant air over the magnetron power supply and magnetron tube, for example. As a result, the flow of coolant air passes longitudinally down the waveguide transmission line and through the grid-like members supporting the clamping plates of the pressure means. Thus, the grid-like structures of the support members permit the flow of coolant air to pass readily through the coupon bonding chamber to the terminating end portion of the waveguide transmission line where it is exhausted from the line. As a result, the flow of coolant air reduces operating temperatures not only of the waveguide side walls but also of the dielectric pressure means including the clamping plates disposed in pressure engagement with opposing broad surfaces of the test sandwich assembly.

BRIEF DESCRIPTION OF THE DRAWINGS

For a better understanding of the invention, reference is made in the following detailed description to the accompanying drawings wherein.

DESCRIPTION OF THE PREFERRED EMBODIMENT

Figure 1:
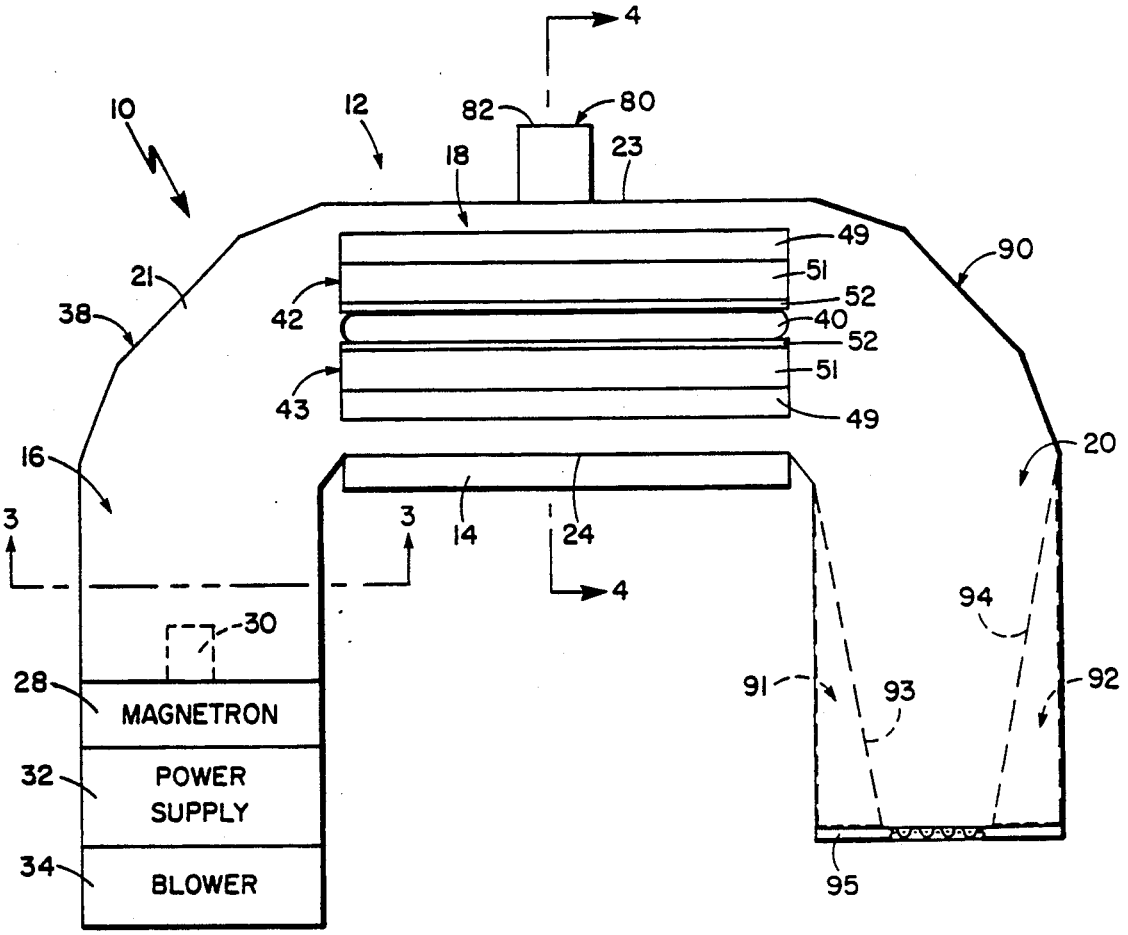
FIG. 1 is a side elevational view of a test bonding apparatus embodying the invention.
Figure 2:
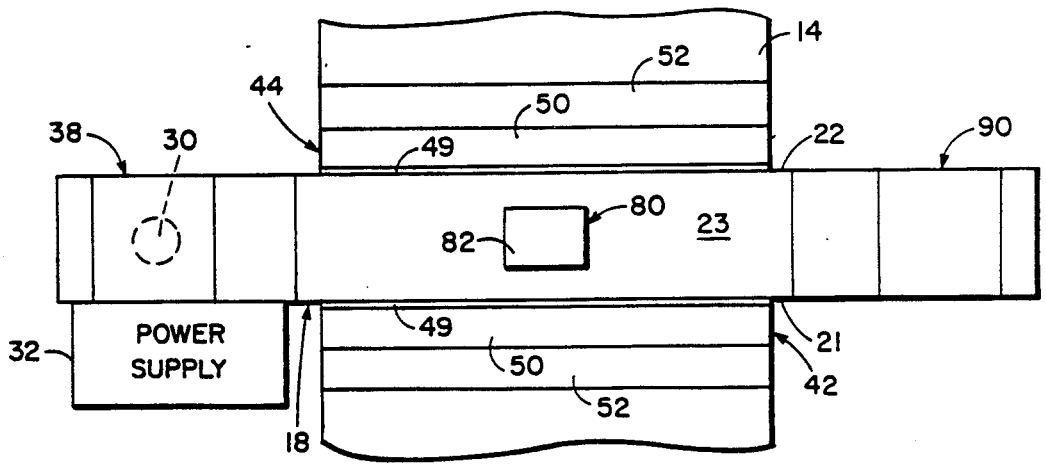
FIG. 2 is a top plan view of the test bonding apparatus shown in FIG. 1.
Figure 3:
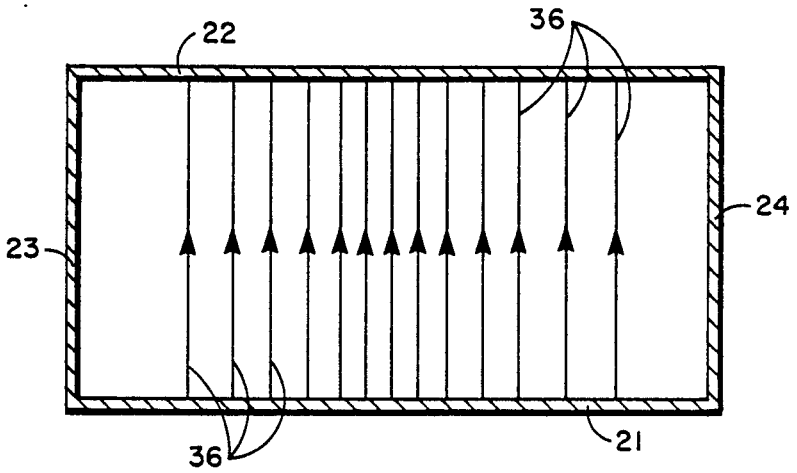
FIG. 3 is an enlarged cross-sectional schematic view taken along the line 3—3 shown in FIG. 1 and looking in the direction of the arrows.

Referring to the drawings wherein like characters of reference designate like parts, there is shown in FIGS. 1–3 a test bonding apparatus 10 including a microwave transmission line comprising a waveguide 12 which may be supported by conventional means, such as counter top 14, for example. The waveguide 12 has an input end portion 16 connected through an intermediate portion comprising coupon bonding chamber 18 to a terminating end portion 20 of the waveguide. Waveguide 12 has a generally rectangular cross-section formed by a pair of relatively wide side walls, 21 and 22, respectively, having their longitudinal edge portions joined to an orthogonal pair of relatively narrow side walls, 23 and 24, respectively, of the waveguide. The respective side walls 21-24 of waveguide 12 are made of electrically conductive material, such as aluminum material, for example, and extend from the input end portion 16 to the terminating end portion 20 of the waveguide.

The input end portion 16 of waveguide 12 is coupled to a microwave source which may comprise a conventional magnetron tube 28 having an output antenna-like probe 30 extended longitudinally into the input end portion 16 of the waveguide. Magnetron tube 28 is connected electrically to a suitable power supply 32 for producing the voltage necessary to activate tube 28. When activated, the magnetron tube 28 generates microwave energy having a predominant frequency, such as about twenty-four hundred and fifty megahertz, for example, and an associated predetermined wavelength, such as about four and eight-tenths inches, for example. As a result, the microwave energy generated by magnetron tube 28 is radiated consistently from the probe 30 and propagated longitudinally from the input end portion 16 of waveguide 12. The input end portion 16 of waveguide 12 also is disposed in communication with a source of coolant fluid, such as an electrically powered blower 34 of a conventional type disposed for blowing coolant air over the power supply 32 and the magnetron tube 28, for example. This flow of coolant air from the blower 34 is directed longitudinally into the input end portion 16 of waveguide 12. The magnetron tube 28, power supply 32 and blower 34 may be supported for functioning as described by being attached to suitable support means, such as the support structure (not shown) for maintaining counter top 14 in position, for example.

The relatively wide side walls 21 and 22 of waveguide 12 have respective similar width dimensions, each of which preferably is between one half and one of the aforesaid predetermined wavelength of microwave energy radiated from probe 30. Also, the relatively narrow side walls 23 and 24 have respective similar width dimensions, each of which preferably is less than one half of the aforesaid predetermined wavelength of microwave energy radiated from probe 30. Moreover, each of the width dimensions of the relatively narrow side walls 23 and 24 preferably is about one-half of each of the width dimensions of the relatively wide side walls 20 and 21. Accordingly, if the predetermined wavelength is about four and eight-tenths inches, for example, each of the relatively wide side walls 21 and 22 may have a respective width dimension of about four inches, and each of the relatively narrow side walls 23 and 24 may have a respective width dimension of about two inches. As a result, the microwave energy radiated from probe 30 will be propagated longitudinally into the input end portion 16 of waveguide 12 in a preferred $TE_{10}$ mode. Consequently, as shown in FIG. 3, the propagated microwave energy will have electric field vectors 36 extending approximately perpendicular to the relatively wide side walls 20 and 21, respectively, and substantially parallel with the relatively narrow side walls 23 and 24, respectively, of the waveguide 12.

The waveguide 12 may be provided with a conventional H-plane bend portion 38 for maintaining the microwave energy from input end portion 16 in the preferred $TE_{10}$ mode while changing the direction of propagation by about ninety degrees. As a result, the microwave energy is propagated longitudinally into the coupon bonding chamber 18 with the electric field vectors 36 still approximately perpendicular to the relatively wide side walls 20 and 21, respectively, and substantially parallel with the relatively narrow side walls 23 and 24, respectively. The input end portion 16 of waveguide 12, alternatively, may be aligned linearly with the coupon bonding chamber 18 thereby eliminating the need for H-plane bend portion 38 of waveguide 12. Thus, the microwave energy may be propagated in the preferred $TE_{10}$ mode from the input end portion 16 directly into the coupon bonding chamber 18 without altering the direction of propagation.

Figure 4:
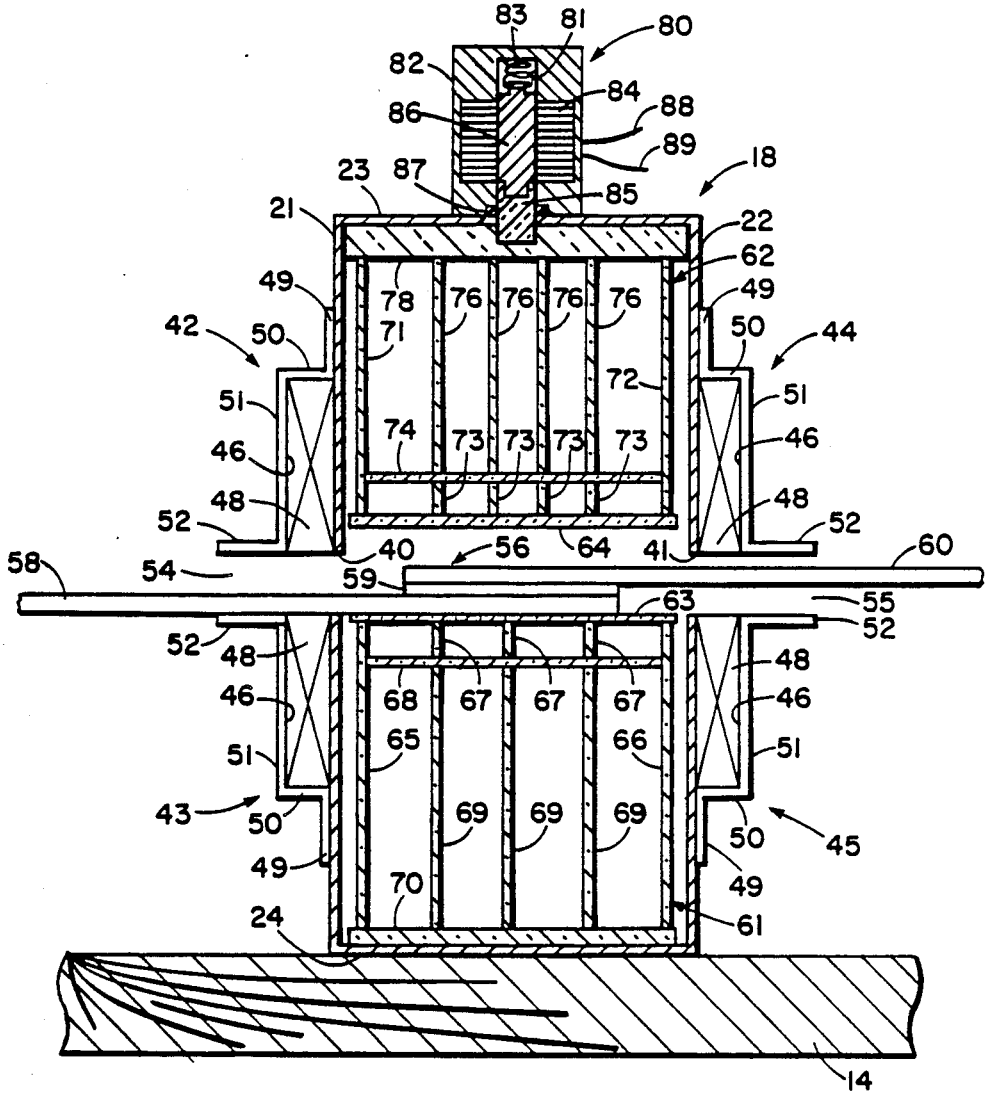
FIG. 4 is an enlarged cross-sectional schematic view taken along the line 4—4 shown in FIG. 1 and looking in the direction of the arrows.

In the coupon bonding chamber portion of waveguide 12, as shown in FIG. 4, there is disposed substantially on the longitudinal centerlines of relatively wide side walls 20 and 21 an entrance slot 40 and an exit slot 41, respectively. The slots 40 and 41 are elongated in the longitudinal direction and may extend substantially the entire length of coupon bonding chamber 18. Consequently, the slots 40 and 41 are relatively narrow and may have respective lengths which are considerably greater than their respective widths, such as ten to twenty times greater, for example. Therefore, each of the slots 40 and 41 may have a length of about four inches and a width of about one-quarter of an inch, for example. The slots 40 and 41 also extend from the exterior surfaces of side walls 20 and 21, respectively, through the thicknesses thereof and into communication with the interior of coupon bonding chamber 18. Accordingly, the slots 40 and 41 are disposed substantially perpendicular to the electric field vectors 36 (FIG. 3) which extend substantially parallel with the relatively narrow walls 23 and 24, respectively, within the waveguide 12. As a result, the slots 40 and 41 do not interfere substantially with the electric and magnetic fields of microwave energy propagated in the $TE_{10}$ mode within waveguide 12. Thus, by disposing the elongated slots 40 and 41 substantially along the longitudinal centerlines of side walls 20 and 21, respectively, and providing them with respective narrow configurations, as described, leakage of microwave energy through the respective slots 40 and 41 may be minimized.

Moreover, there is disposed on opposing longitudinal sides of the entrance slot 40 microwave choke devices 42 and 43, respectively, which are supported on the exterior surface of waveguide side wall 20 in substantially coextensive relationship with entrance slot 40. Similarly, there is disposed on opposing longitudinal sides of the exit slot 41 microwave choke devices 44 and 45, respectively, which are supported on the exterior surface of waveguide side wall 21 in substantially coextensive relationship with exit slot 41. The choke devices 42–45 are of the type related to one quarter of an "effective" wavelength of the microwave energy, which includes not only the aforesaid predetermined wavelength of microwave energy as radiated in air but also the corresponding shorter wavelength as propagated in a dielectric medium. Choke devices 42–45 have respective defining wall portions made of electrically conductive material, such as aluminum sheet material, for example. The defining wall portions of choke devices 42–45, in cooperation with respective adjacent wall portions of waveguide 12, form respective quarter wavelength cavities 46. Preferably, the cavities 46 are filled with dielectric material 48, such as silicone rubber, for example, in order to provide each of the choke devices 42–45 with a respective compact size. Alternatively, the choke devices 42–45 may be provided with respective cavities (not shown) having no dielectric media therein and having respective dimensions increased accordingly.

The choke devices 42–45 have respective flange members 49 which interface with adjacent wall portions of waveguide 12 and are affixed thereto, as by welding, for example. Flange members 49 are integrally joined to respective transverse members 50 of choke devices 42–45 comprising respective closed ends of the quarter wavelength cavities 46. Transverse members 50 are integrally joined to adjacent end portions of respective longitudinal members 51 of choke devices 42–45 defining respective outer sides of the cavities 46. The longitudinal members 51 extend in spaced, substantially parallel relationship with respective opposing wall portions of waveguide 12 and, in cooperation therewith, determine the respective width dimensions of cavities 46. Also, the longitudinal members 51 have respective opposing end portions which may be integrally joined to respective right-angled guide members 52 of the choke devices 42–45.

The respective guide members 52 of choke devices 42 and 43 are disposed in spaced opposing relationship with one another and form therebetween an inlet channel 54. Inlet channel 54 extends between open ends of the respective cavities 46 of choke devices 42 and 43 which are disposed on opposing longitudinal sides of entrance slot 40 and are substantially coextensive therewith. Similarly, the respective guide members 52 of choke devices 44 and 45 are disposed in spaced opposing relationship with one another and form therebetween an outlet channel 55. Outlet channel 55 extends between open ends of the respective cavities 46 of choke devices 44 and 45 which are disposed on opposing longitudinal sides of exit slot 41 and are substantially coextensive therewith. Accordingly, the transverse members 50 of choke devices 42 and 43, respectively, are located from the longitudinal centerline of entrance slot 40 a distance approximately equal to one quarter of the aforesaid effective wavelength of microwave energy in the dielectric materials 48 within the respective cavities 46 of choke devices 42 and 43. As a result, there is established in series with the entrance slot 40 a high impedance which prevents the egress of microwave energy through the entrance slot 40. Also, the transverse members 50 of choke devices 44 and 45, respectively, are located from the longitudinal centerline of exit slot 41 a distance approximately equal to one quarter of the aforesaid effective wavelength of microwave energy in the dielectric materials 48 within the respective cavities 46 of choke devices 44 and 45. Consequently, there is established in series with the exit slot 41 a high impedance which prevents the egress of microwave energy through the exit slot 41.

Therefore, the entrance and exit slots 40 and 41, respectively, provide access to the interior of coupon bonding chamber 18 whereby a test sandwich assembly 56 may be readily inserted into the coupon bonding chamber 18 for a desired interval of time and then removed. The test sandwich assembly 56 may comprise two elongated coupons, 58 and 60, respectively, of plastic sheet material having respective overlapping end portions with a layer 59 of thermosetting adhesive material therebetween. The test sandwich assembly 56 may be inserted to have the respective overlapping end portions of coupons 58 and 60 positioned within the coupon bonding chamber 18 while the opposing end portion of coupons 58 and 60 extend out of the entrance slot 40 and the exit slot 41, respectively. Thus, the opposing end portion of coupon 58 may be used for the insertion; and the opposing end portion of coupon 60 may be used for the withdrawal of test sandwich assembly 56 from the chamber 18. While in the coupon bonding chamber 18, the overlapping end portions of coupons 58 and 60, respectively, and the interposed layer 59 of thermosetting adhesive material are heated directly by the microwave energy propagated longitudinally along waveguide 12. As a result, the curing of layer 59 is enhanced such that the time interval required for maintaining the test sandwich assembly 56 in chamber 18 is surprisingly short, such as about ten seconds, for example.

In the coupon bonding chamber 18, the test sandwich assembly 56 may be disposed in a clamping means comprising a stationary press 61, which is secured in the lower longitudinal half of chamber 18, and an aligned press 62 which is movably supported in the upper longitudinal half of chamber 18. The presses 61 and 62 are longitudinally coextensive with the respective slots 40–41, and have respective grid-like structures which are made of rigid dielectric material, such as polysulfone, for example. Stationary press 61 has disposed substantially coplanar with the lower longitudinal sides of respective slots 40–41 a work contacting surface of a panel-like clamping element 63. The clamping element 63 extends transversely of chamber 18 from adjacent the entrance slot 40 to adjacent the exit slot 41, and extends longitudinally from respective adjacent ends of the slots 40–41 to respective opposing ends thereof. Opposing longitudinal edge portions of the clamping element 63 are attached in a conventional manner to adjacent longitudinal edge portions of orthogonal panel-like side elements, 65 and 66, respectively, of the stationary press 61. The side elements 65 and 66 may be longitudinally coextensive with the clamping element 63 and extend in spaced, substantially parallel relationship with the relatively wide side walls 21 and 22, respectively, of chamber 18. It should be noted that the press 61 has opposing open ends disposed adjacent the input end portion 16 and the terminating end portion 20, respectively of waveguide 12.

Disposed between the end portions of side elements 65 and 66 adjacent clamping element 63 is a plurality of strengthening joists 67 which may be longitudinally coextensive with the respective side elements 65 and 66 of press 61. The joists 67 extend in spaced, substantially parallel relationship with one another and with the side elements 65 and 66, respectively. Joists 67 have respective longitudinal edge portions attached in a conventional manner to the clamping element 63, and have respective opposing edge portions secured in a similar manner to an adjacent broad surface of a cross bracing board 68. The bracing board 68 may be longitudinally coextensive with the clamping element 63 and is disposed in spaced, substantially parallel relationship therewith. Bracing board 68 may have opposing longitudinal edge portions secured in a conventional manner to the adjacent side elements 65 and 66, respectively, of press 61. Secured to the opposing broad surface of the bracing board 68 is a plurality of panel-like partitions 69 which may be longitudinally coextensive with the respective side elements 65 and 66. The partitions 69 may be aligned with respective joists 67 to extend in spaced substantially parallel relationship with one another and with the side elements 65–66, respectively. Each of the side elements 65–66 and of the partitions 69 has a respective opposing longitudinal edge portion attached to an adjacent broad surface of a panel-like base element 70 which may be similar in configuration and extent to the clamping element 63. Base element 70 has an opposing broad surface interfacing with the adjacent inner surface of narrow side wall 23 of waveguide 12, and is fixedly attached thereto by conventional means.

Movable press 62 has disposed adjacent the opposing longitudinal sides of respective slots 40–41 a panel-like clamping element 64 which has one of its broad surface disposed as a work contacting surface. The work contacting surface of clamping element 64 is aligned in spaced opposing relationship with the work contacting surface of clamping element 63 in stationary press 61. Clamping element 64 extends transversely of chamber 18 from adjacent the entrance slot 40 to adjacent the exit slot 41, and extends longitudinally from respective adjacent ends of the slots 40–41 to respective opposing ends thereof. The clamping element 64 has an opposing broad surface with respective opposing longitudinal edge portions attached in a conventional manner to adjacent longitudinal edge portions of orthogonal panel-like side elements 71 and 72, respectively. Side elements 71 and 72 may be longitudinally coextensive with the clamping element 64 and extend in spaced, substantially parallel relationship with the relatively wide side walls 21 and 22, respectively, of chamber 18. It should be noted that the movable press 62 has opposing open ends disposed adjacent the input portion 16 and the terminating end portion 20, respectively, of waveguide 12.

Disposed between the end portions of side elements 71 and 72 adjacent clamping element 64 is a plurality of strengthening joists 73 which may be longitudinally coextensive with one another and with the respective side elements 71 and 72 of press 62. The joists 73 extend in spaced, substantially parallel relationship with one another and with the side elements 71 and 72, respectively. Joists 73 have respective longitudinal edge portions attached in a conventional manner to the clamping element 64 and have respective opposing edge portions secured in a similar manner to an adjacent broad surface of a cross bracing board 74. The bracing board 74 may be longitudinally coextensive with the clamping element 64 and is disposed in spaced, substantially parallel relationship therewith. Bracing board 74 may have opposing longitudinal edge portions attached in a conventional manner to respective aligned portions of the side elements 71 and 72.

Secured to the opposing broad surface of bracing board 74 is a plurality of panel-like partitions 76 which may be longitudinally coextensive with the respective side elements 71 and 72. The partitions 76 may be aligned with respective joists 73 to extend in spaced, substantially parallel relationship with one another and with the side elements 71–72, respectively. Each of the side elements 71–72 and of the partitions 76 has a respective opposing longitudinal edge portion attached to an adjacent broad surface of a relatively thicker base element 78 which may be similar in configuration and longitudinal extent to the clamping element 64. The base element 78 has opposing longitudinal edges slidably engaging respective inner surfaces of the relatively wide side walls 21 and 22 of waveguide 12. Base element 78 has an opposing broad surface which may interface with the adjacent inner surface of narrow side wall 23 of waveguide 12 when the clamping element 64 of press 62 is spaced a maximum distance from the clamping element 63 of press 61.

Fixedly mounted on the external surface of narrow side wall 23 is a cylindrical solenoid 80 having a metal housing 82 wherein an electrical coil 84 encircles a rod-like armature or core 86. The core 86 is made of a ferromagnetic material, such as soft iron, for example, and is disposed with its axis substantially perpendicular to the narrow side wall 23 of waveguide 12. Core 86 has a lower end portion fastened, as by threading engagement, for example, in abutting relationship with an adjacent end portion of a colinear core extension 85. The core extension 85 comprises a rod-like member which is made of suitable dielectric material, such as polysulfone material, for example, and is extended slidably through an axially aligned grommet 87. Grommet 87 is made of lossy resilient material, such as a carbon loaded rubber material, for example, and is disposed in a suitably sized counterbore in an adjacent end surface of housing 82. The dielectric core extension 85 is extended slidably through an aligned aperture in side wall 23 and is projected into the interior of coupon bonding chamber 18. In the chamber 18, core extension 85 has an opposing end portion secured by conventional means to a central portion of base element 78 of press 62.

Housing 82 has a lower end portion provided with an external flange which is fixedly secured, as by spot welding, for example, to the side wall 23 of waveguide 12. The housing 82 also is provided with an opposing distal end portion having an inner surface wherein a cup-shaped recess 81 is centrally disposed for receiving one end portion of an aligned coil spring 83. Coil spring 83 has an opposing end portion encircling an adjacent reduced diameter portion of the core 86 to which it is secured in a conventional manner. The electrical coil 84 has a pair of terminating electrical conductors, 88 and 89, respectively, extended insulatingly out of housing 82 to provide means for electrically energizing the coil 84. When thus energized, the coil 84 magnetically attracts the ferromagnetic core 86 up into the coil 84 thereby compressing the spring 83. As a result, the base element 78 of press 62 is held in abutting relationship with the narrow side wall 23 of waveguide 12; and the clamping element 64 of press 62 is maintained in maximum spaced relationship with the clamping element 63 of press 61.

When the test sandwich assembly 56 is positioned within the coupon bonding chamber 18, as described, the coil 84 of solenoid 80 may be de-energized thereby allowing the spring 83 to expand and exert a pushing force on the core 86. Consequently, the core 86 slides downwardly through the grommet 87; and the press 62 slides downwardly along the relatively wide side walls 21 and 22, respectively, of waveguide 12. Thus, the clamping element 64 of press 62 is brought into interfacing pressure engagement with the coupon 60 of test sandwich assembly 56. As a result, the clamping element 64 cooperates with the clamping element 63 in applying a uniform pressure over the entire portion of test sandwich assembly 56 comprising the layer 59 of thermosetting adhesive material between the overlapping end portions of coupons 58 and 60, respectively. The clamping pressure, thus applied, between the respective clamping elements 63 and 64 should be on the order of about one pound per square inch, for example. This clamping pressure should be sufficient to prevent curling of the respective coupons 58 and 60 during microwave heating without forcing adhesive material in layer 59 out of the test sandwich assembly 56.

When the specified curing time interval has expired, the coil 84 is energized to attract the core 86 magnetically back into the coil 84 until the spring 83 is again compressed the desired amount. As a result, the movable press 62 will slide reciprocally back along the respective wide side walls 21 and 22 of waveguide 12 to space the clamping element 64 a maximum distance from clamping element 63. Then, the test sandwich assembly 56 may be withdrawn via exit slot 41 from chamber 18 for testing, such as shear testing, for example, to determine the strength of the bond provided by the cured adhesive material of layer 59.

It should be noted that during the curing process the microwave energy propagated longitudinally through the coupon bonding chamber 18 produces not only a desired heating of the adhesive material in layer 59 but also an undesired heating of the respective presses 60–61 and of the respective walls 21–24 of waveguide 12. However, the grid-like structures of the respective presses 60–61 provide a plurality of longitudinally extending tunnels whereby the flow of coolant fluid from blower 34 in input end portion 16 is enabled to pass readily through the coupon bonding chamber 18. The resulting flow of coolant fluid through the respective presses 61–62 and along the respective walls 21–24 forming chamber 18 carries heat away therefrom and into the terminating end portion 20 of waveguide 12. Therefore, the flow of coolant fluid may be adjusted for maintaining the respective presses 61–62 and the respective walls 21–24 at acceptable operating temperatures independently of the time interval the adhesive material in layer 59 is being heated directly by the microwave energy propagated through chamber 18. Also, the leading edges (not shown) of the respective component parts forming the grid-like structures of presses 61 and 62 may be tapered suitably for minimizing reflections of microwave energy back toward the input end portion 16 of waveguide 12. Thus, the coupon bonding chamber is designed for having the structural features thereof in a stabilized arrangement with regard to the propagated microwave energy so that the microwave heating of the adhesive material in layer 59 takes place in a consistent manner. Consequently, the testing results obtained from the test sandwich assembly 56 may be repeated reliably with a similar test sandwich assembly heated in the coupon bonding chamber 18 for a similar length of time.

The coupon bonding chamber 18 may communicate with the terminating end portion 20 of waveguide 12 through a conventional H-plane bend portion 90 thereof for maintaining the microwave energy transmitted from chamber 18 in the preferred $TE_{10}$ mode while changing the direction of propagation by about ninety degrees. As a result, the microwave energy is propagated longitudinally into the terminating end portion 20 with the electric field vectors 36 (FIG. 3) approximately perpendicular to the wide side walls 21 and 22, respectively, of waveguide 12. The terminating end portion 20, alternatively, may be aligned linearly with the coupon bonding chamber 18 thereby eliminating the need for H-plane bend portion 90 of waveguide 12. Thus, the microwave energy may be propagated in the preferred $TE_{10}$ mode from the coupon bonding chamber 18 directly into the terminating end portion 20 of waveguide 12 without altering the direction of propagation.

In the terminating end portion of waveguide 12, there is provided a matched load means comprising respective wedge-shaped members 91 and 92 which are longitudinally and laterally coextensive with respective narrow side walls 23 and 24 of waveguide 12. The wedge-shaped members 91 and 92 are made of a microwave lossy material, such as ferrite loaded silicone matrix material, for example, for dissipating the microwave energy received from coupon bonding chamber 18. Wedge-shaped members 91 and 92 have respective longitudinally extending surfaces which are disposed in interfacing relationship with the inner surfaces of narrow side walls 23 and 24, respectively, and may be fixedly secured thereto in a conventional manner. The respective longitudinally extending surfaces of wedge-shaped members 91 and 92 meet with respective sloped surfaces 93 and 94 thereof to form respective thin ends of the wedge-shaped members 91 and 92 adjacent the entrance end of terminating end portion 20. Consequently, the terminating end portion 20 has adjacent the thin ends of wedge-shaped members 91 and 92, respectively, an entrance opening which is approximately equal in size to the size of the rectangular cross-section defined by the respective walls 21–24 of waveguide 12.

The sloped surfaces 93 and 94 are disposed in spaced opposing relationship with one another and taper similarly inward of terminating end portion 20 with increasing longitudinal distance from the entrance opening thereof. As a result, the wedge-shaped members 91 and 92 terminate adjacent an opposing exit end of terminating end portion 20 with respective thick end portions defining an interposed exit opening which is considerably smaller in size than the size of the entrance opening of terminal end portion 20. Thus, as the microwave energy from coupon bonding chamber 18 propagates longitudinally into terminating end portion 20, increasing amounts of lossy material in wedge-shaped members 91 and 92, respectively, are placed interceptingly in the path of propagation for absorbing the microwave energy. Secured by conventional means across the exit opening of terminating end portion 20 is a screen member 95 having a predetermined mesh size. The mesh size of screen member 95 is sufficiently small to reflect microwave energy passing through the exit opening back into terminating end portion 20 for absorption by the wedge-shaped members 91 and 92, respectively. On the other hand, the mesh size of screen member 95 is sufficiently large to permit a smooth egression of coolant fluid, which has been flowed through coupon bonding chamber 18 by blower 34, in order to carry heat away from the waveguide 12.

Thus, there has been disclosed herein a test bonding apparatus comprising waveguide 12 having an input end portion coupled to input energy means for directing microwave energy and coolant fluid through a coupon bonding chamber portion 18 of the waveguide 12 in a consistent manner. Furthermore, the waveguide 12 includes an output end portion coupled to the coupon bonding chamber 18 and provided with matched load means for dissipating the excess microwave energy while permitting the coolant fluid to carry heat away from the waveguide. Although the coupon bonding chamber 18 has been shown herein as having an entrance slot 40 and an opposing exit slot 41, the bonding chamber 18 could function equally as well with only one of the slots serving as both the entrance slot and the exit slot. Moreover, although the choke devices 42–45 have been shown as supported on external surfaces of respective wall portions adjacent the slots 40 and 41, the choke devices 42–45 alternatively may be supported on internal surfaces of the respective wall portions adjacent the slots 40 and 41.

From the foregoing, it will be apparent that all of the objectives have been achieved by the structures and methods described herein. It also will be apparent, however, that various changes may be made by those skilled in the art without departing from the spirit of the inventive subject matter, as expressed in the appended claims. It is to be understood, therefore, that all matter shown and described herein is to be interpreted as illustrative and not in a limiting sense.

The subject matter claimed is:

1. A test bonding apparatus comprising:

a waveguide having electrically conductive wall means for providing said waveguide with an input portion, a terminating end portion and an intermediate coupon bonding chamber portion having an interior disposed in communication with said input portion and said terminating end portion of said waveguide, and for transmitting microwave energy from said input portion through said interior of said coupon bonding chamber portion into said terminating end portion;

aperture means extended through said electrically conductive wall means in said coupon bonding chamber portion and into communication with said interior thereof for providing access to said interior of said coupon bonding chamber portion from externally of said waveguide, and for permitting insertion into said interior and removal therefrom of a coupon test sandwich assembly; and said coupon bonding chamber portion including clamping means disposed within said coupon bonding chamber portion for holding said coupon test sandwich assembly while being heated by said microwave energy transmitted through said coupon bonding chamber portion.

2. A test bonding apparatus as set forth in claim 1 wherein said electrically conductive wall means includes side wall means extended longitudinally of said waveguide and comprised of a first pair of spaced opposing side walls having respective first widths similar to one another and an orthogonally disposed second pair of spaced opposing side walls having respective second widths similar to one another, said side walls of said first pair being relatively wider than said side walls of said second pair and being attached thereto for providing said waveguide with a rectangular cross-section having a first dimension parallel to said first pair of side walls and substantially greater than an orthogonal second dimension parallel to said second pair of side walls.

3. A test bonding apparatus as set forth in claim 2 wherein said aperture means includes a longitudinal entrance slot disposed substantially along a longitudinal centerline of one of said first pair of side walls and extended through the thickness thereof into communication with said interior of said coupon bonding chamber portion, and a longitudinal exit slot disposed substantially along a longitudinal centerline of the other one of said first pair of side walls and extended through the thickness thereof into communication with said interior of said coupon bonding chamber portion.

4. A test bonding apparatus as set forth in claim 3 further comprising choke means disposed on said electrically conductive wall means and adjacent said aperture means, said choke means having dimensions related to said microwave energy for preventing egress of said microwave energy through said aperture and enhancing consistent propagation of said microwave energy through said interior of said coupon bonding chamber portion of said waveguide wherein said choke means includes a first pair of choke devices disposed coextensively with said entrance slot and on respective opposing longitudinal sides thereof, and a second pair of choke devices disposed coextensively with said exit slot and respective opposing longitudinal side thereof.

5. A test bonding apparatus as set forth in claim 4 wherein each of said choke devices of said first pair includes first cavity means having an open end disposed adjacent said entrance slot and having an opposing closed end spaced a predetermined distance therefrom, and each of said choke devices of said second pair includes second cavity means having an open end disposed adjacent said exit slot and having an opposing closed end spaced said predetermined distance therefrom.

6. A test bonding apparatus as set forth in claim 5 wherein each of said cavities is filled with respective dielectric material.

7. A test bonding apparatus as set forth in claim 5 wherein said clamping means includes a stationary clamping plate supported substantially coplanar with one longitudinal of said entrance slot and a movable clamping plate supported in alignment with said stationary clamping plate.

8. A test bonding apparatus as set forth in claim 7 wherein said clamping means includes a stationary grid-like dielectric means for supporting said stationary clamping plate and a movable grid-like dielectric means for supporting said movable clamping plate.

9. A test bonding apparatus as set forth in claim 8 wherein said clamping means includes reciprocal movable means attached to said movable grid-like dielectric means for moving said movable clamping plate into pressure engagement with said coupon test sandwich assembly after said insertion thereof into said interior of said coupon bonding chamber portion and for moving said movable clamping plate out of pressure engagement with said coupon test sandwich assembly prior to said removal thereof from said coupon bonding chamber portion.

10. A test bonding apparatus comprising:

a waveguide having electrically conductive wall means for providing said waveguide with an input portion, a terminating end portion and an intermediate coupon bonding chamber portion having an interior disposed in communication with said input portion and said terminating end portion of said waveguide, for transmitting microwave energy and coolant fluid flow from said input portion through said interior of said coupon bonding chamber portion into said terminating end portion of said waveguide;

input means coupled to said input portion of said waveguide for directing said microwave energy and said coolant fluid flow into said input portion of said waveguide;

pervious means disposed in said coupon bonding chamber portion for maintaining a consistent propagation of said microwave energy and said coolant fluid flow through said interior of said coupon bonding chamber portion;

said pervious means including slotted aperture means disposed in said electrically conductive wall means in said coupon bonding chamber portion for providing access to said interior of said coupon bonding chamber portion from externally of said waveguide, said pervious means further including choke means disposed on said electrically conductive wall means adjacent said slotted aperture means for permitting passage of a bonding test sample through said slotted aperture means and preventing egress of said microwave energy through said slotted means from said interior of said coupon bonding chamber portion;

said pervious means further including pressure means disposed in said coupon bonding chamber portion and aligned with said slotted aperture means for clamping said bonding test sample in said coupon bonding chamber portion, said pressure means having a grid-like structure provided with a plurality of tunnel-like aperture means for cooperating in said maintaining of said consistent propagation of said microwave energy and said coolant fluid flow through said interior of said coupon bonding chamber portion; and output means disposed in said terminating end portion of said waveguide for receiving said microwave energy and said flow of coolant fluid from said coupon bonding chamber, said output means including matched load means for dissipating said microwave energy and fluid permeable means for allowing passage of said coolant fluid and restricting passage of said microwave energy out of said waveguide.

11. A test bonding apparatus as set forth in claim 10 wherein said fluid permeable means includes screen means disposed in said terminating end portion of said waveguide and having a predetermined mesh size for reflecting said microwave energy and permitting passage of said flow of coolant fluid out of said waveguide.

12. A test bonding apparatus as set forth in claim 11 wherein said matched load means includes tapered lossy means disposed between said coupon bonding chamber portion and said screen means in said terminating end portion of said waveguide for dissipating said received microwave energy and permitting passage of said flow of coolant fluid.

* * * * *